US011091241B2

(12) United States Patent
Despineux et al.

(10) Patent No.: US 11,091,241 B2
(45) Date of Patent: Aug. 17, 2021

(54) BOAT DRIVE

(71) Applicant: Torqeedo GmbH, Gilching (DE)

(72) Inventors: Frank Despineux, Wessling (DE); Anton Spengler, Diessen am Ammersee (DE)

(73) Assignee: Torqeedo GmbH, Gilching (DE)

( * ) Notice: Subject to any disclaimer, the term of this patent is extended or adjusted under 35 U.S.C. 154(b) by 0 days.

(21) Appl. No.: 16/522,556

(22) Filed: Jul. 25, 2019

(65) Prior Publication Data

US 2020/0031447 A1 Jan. 30, 2020

(30) Foreign Application Priority Data

Jul. 26, 2018 (DE) ..... 102018118163.9

(51) Int. Cl.

| | |
|---|---|
| ***B63H 20/00*** | (2006.01) |
| ***B63H 20/06*** | (2006.01) |
| ***B63H 21/30*** | (2006.01) |
| ***B63H 1/14*** | (2006.01) |

(52) U.S. Cl.

CPC ..... *B63H 20/007* (2013.01); *B63H 20/06* (2013.01); *B63H 21/305* (2013.01); *B63H 1/14* (2013.01)

(58) Field of Classification Search

CPC .... B63H 20/007; B63H 20/06; B63H 21/305; B63H 1/14; B63H 21/17; B63H 2005/1258; B63H 2005/075; B63H 21/302; B63H 5/07; B63B 17/0081

See application file for complete search history.

(56) References Cited

U.S. PATENT DOCUMENTS

| | | | | |
|---|---|---|---|---|
| 4,063,060 | A * | 12/1977 | Litch, III | F04D 29/282 219/93 |
| 4,787,868 | A | 11/1988 | Hoshiba et al. | |
| 4,944,702 | A | 7/1990 | Cain | |
| 5,786,647 | A * | 7/1998 | Vollmer | H02K 5/24 310/89 |
| 5,967,863 | A | 10/1999 | Marchant | |
| 6,318,329 | B1 * | 11/2001 | Sato | F02B 61/045 123/192.1 |
| 7,061,147 | B2 | 6/2006 | Ries | |
| 8,888,065 | B2 | 11/2014 | Logan | |
| 9,664,248 | B2 * | 5/2017 | McGuire | B62D 5/0421 |
| 9,856,006 | B2 | 1/2018 | Seitz | |
| 2003/0054705 | A1 | 3/2003 | Le Bert et al. | |
| 2004/0245865 | A1 | 12/2004 | Ries | |
| 2005/0042944 | A1 | 2/2005 | Brach et al. | |

(Continued)

FOREIGN PATENT DOCUMENTS

| | | | |
|---|---|---|---|
| CN | 1550061 | A | 11/2004 |
| CN | 102015438 | A | 3/2015 |

(Continued)

*Primary Examiner* — Anthony D Wiest

(74) *Attorney, Agent, or Firm* — Greenberg Traurg, LLP; David J. Dykeman; Roman Fayerberg

(57) ABSTRACT

The present disclosure relates to a boat drive for driving a boat, comprising a drive unit comprising an electric motor and a mounting connected to the drive unit for connecting the boat drive to the boat, wherein the mounting is provided for distancing the drive unit from a hull of the boat, wherein a decoupling arrangement for decoupling of oscillations (S) generated in the drive unit is arranged between the drive unit and the mounting.

19 Claims, 10 Drawing Sheets

(56) References Cited

U.S. PATENT DOCUMENTS

| | | | | |
|---|---|---|---|---|
| 2009/0191773 | A1 | 7/2009 | Lloyd | |
| 2010/0055999 | A1 | 3/2010 | Wright et al. | |
| 2016/0033001 | A1 | 2/2016 | McGuire et al. | |
| 2018/0281914 | A1* | 10/2018 | Burton | B63H 20/12 |

FOREIGN PATENT DOCUMENTS

| | | | |
|---|---|---|---|
| CN | 102712354 | B | 3/2016 |
| CN | 107298161 | A | 10/2017 |
| EP | 1010614 | A1 | 6/2000 |
| EP | 1366984 | A1 | 12/2003 |
| WO | 2010093305 | A1 | 8/2010 |

* cited by examiner

BOAT DRIVE

CROSS REFERENCE TO RELATED APPLICATIONS

This application claims priority to and the benefit of German Patent Application No. DE 10 2018 118 163.9, filed Jul. 26, 2018, the entirety of which is incorporated herein by reference.

TECHNICAL FIELD

The present disclosure relates to a boat drive for driving a boat, in particular an outboard drive or a pod drive.

BACKGROUND

It is known to use boat drives with electric motors for moving boats, for example for maneuvering. In this case it is known in particular to provide the aforementioned boat drives as inboard drives, outboard drives, sail drives or as pod drives.

In order to supply the electric drives with power, batteries carried in the boat are usually used, which can be charged for example by means of a charger provided with a shore connection. If no shore connection is available, for example because the boat is moving, generators with a combustion engine can be provided on the boat in order to charge the batteries, or solar cells or wind generators are known, by means of which the batteries can be charged.

In the case of boat drives in the form of an outboard motor, as a rule these are attached at the stern of a boat. In the case of boats with a transom stern this attachment can be achieved particularly simply in structural terms by means of a corresponding mounting. Outboard motors usually have a shaft and a propeller which is arranged at the lower end of the shaft and by means of which a motor is driven. In the case of outboard motors with a combustion engine the motor is usually arranged at the upper end of the shaft. In the case of outboard motors with an electric motor, the electric motor can be arranged either at the upper end of the shaft or at the lower end of the shaft in a corresponding nacelle. The shaft of the outboard motor is usually pivotably mounted on the mounting, so that the direction of thrust can be selected by pivoting of the propeller in the water.

Pod drives are arranged below a hull section of the boat. Electrical pod drives can have a drive unit arranged in a separate housing, also referred to as a nacelle, which is connected by means of a mounting to the boat hull. The drive unit can be arranged pivotably about a pivot axis or can be arranged rigidly below the boat. In contrast to steering rudder controls or rudder propellers, in which a certain approach flow speed and thus a certain moving of the boat is necessary, due to the pivotable arrangement of the drive unit the boat can be controlled precisely and efficiently, even at low speed, and thus accurate maneuvering is facilitated, in particular in confined space and at low speed.

The drive unit of electric outboard motors and electric pod drives usually comprises an electric motor which is connected to the propeller. A transmission can also be interposed between the propeller and the electric motor. During operation of the boat drive the electric motor and, if applicable, the transmission or the propeller generates mechanical vibrations and oscillations, respectively. These oscillations are transmitted by the drive unit to the mounting, if applicable to the shaft of an outboard motor, and further to the driven boat. During travel, undesirable noise emissions ensue due to these oscillations, for example by emission of sound from surfaces on the shaft or shaft head, through the mounting and from parts of the boat which are excited to oscillate. The generated oscillations of the boat, or of parts thereof as well as in particular the resulting noise emissions have a negative effect inter alia on the wellbeing of persons located on board the boat. Furthermore, the noise emissions lead to adverse effects on the environment in general, for example when travelling near shores or in harbors or in sensitive areas, such as conservation areas, recreation areas, or nature reserves. Moreover, an increased emission of sound increases the probability of detection in the event of military use.

US 2009/0191773 A1 discloses a method and a device for absorbing, damping and reducing noises and vibrations during operation of a trolling motor. In this case the drive unit and parts of the shaft are surrounded by a cover, so that on the one hand the noise emissions onto water are reduced and fish are less irritated by these noise emissions during fishing, and on the other hand shock-proofing for the drive unit is provided. However, the provision of the cover has no influence on the propagation of the vibrations and oscillations, respectively, generated in the drive unit to the shaft or the boat having the trolling motor.

SUMMARY

Starting from the known prior art, it is an object of the present disclosure to provide an improved boat drive for driving of a boat, in particular an outboard drive or a pod drive.

The object is achieved by a boat drive for driving of a boat having the features of described in the present disclosure.

In some aspects, a boat drive for driving a boat is proposed, comprising a drive unit comprising an electric motor and a mounting connected to the drive unit for connecting the boat drive to the boat, wherein the mounting is provided for distancing the drive unit from a hull of the boat. According to the present disclosure a decoupling arrangement for decoupling of oscillations generated in the drive unit is arranged between the drive unit and the mounting.

Because a decoupling arrangement for decoupling of oscillations generated in the drive unit is arranged between the drive unit and the mounting, the transmission of the oscillations generated in the drive unit to the mounting, in particular to the shaft thereof, and further via the mounting to the boat itself, can be reduced or even substantially prevented. Here, in particular, oscillations are also understood as the transmission of structure-borne sound.

In other words, due to the decoupling arrangement, a decoupling and/or damping of the oscillations takes place at the connection point between the drive unit and the mounting. Accordingly, due to this decoupling, fewer oscillations, or in the best case no oscillations at all, are relayed or transmitted to the mounting and thus to the shaft, the shaft head or the boat. Furthermore, due to the damping an oscillation or further oscillation of the stimulated parts can be reduced or even completely prevented. Thus, the undesirable noise emissions produced by the oscillations during travel can be reduced, so that a significantly reduced nuisance for the persons located on board the boat occurs.

In order to reduce the introduction of oscillations or transmission, in particular an acoustic impedance discontinuity can also be used. This makes use of the effect that a sound wave propagating in a medium, for example gas, a liquid or a solid body, is reflected to large extent when it impinges on a "boundary layer" to another medium having a significantly different wave propagation speed, or a different speed of sound intrinsic to the material.

With sufficient damping and/or decoupling of the oscillations by the decoupling arrangement, these oscillations can be reduced so significantly that persons located on board the boat or around the boat no longer perceive them and consequently the nuisance is completely prevented.

Furthermore, because of the low noise emissions, boats which are equipped with the proposed boat drive can be below any predetermined threshold values and are entitled to enter sensitive areas, such as conservation areas, recreation areas, or nature reserves. Thus, it is possible, for example, to equip so-called cruise boats or excursion boats with the proposed boat drive in order to facilitate access for holidaymakers and tourists as well as explorers to the aforementioned sensitive areas, without the fauna contained there being harmed or scared away by loud sounds.

The same also applies to the use of the proposed boat drive for driving angling and fishing boats, which improves the possibility of being closer to fish or shoals of fish located in the water.

The decoupling device comprises at least one resilient element, for example a metal spring, a rubber buffer or a combination of a damping element and a spring element. Any material for generating an impedance discontinuity, for example a liquid or a solid body, can be used for interrupting the conduction of structure-borne sound.

Alternatively, the decoupling device can also be configured as a rag joint, with an element produced from a resilient material, such as a disk or plate, which is provided with bushings, usually vulcanized, for example made of metal.

In some embodiments, the decoupling arrangement comprises at least one oscillation decoupling damping element which is arranged between the drive unit and the mounting. In this way a decoupling and/or damping of the vibrations and oscillations generated in the drive unit can be achieved in with a simple structure of the decoupling arrangement, and thus particularly effectively.

In some embodiments, at least one oscillation decoupling damping element comprises metal resilient elements for decoupling, such as metal spiral or leaf springs or so-called wire rope shock absorbers.

At least one oscillation decoupling damping element comprises a resilient material, such as an elastomeric material, particularly rubber. A particularly effective damping of the oscillations and vibrations is also provided, if at least one oscillation decoupling damping element includes polyurethane or a polyurethane compound.

In order to achieve a further improved damping behavior and, in addition, a good support function, the at least one oscillation decoupling damping element can have at least two materials with differing resilience, such as at least two resilient materials.

If the at least one oscillation decoupling damping element is configured as a substantially continuous intermediate layer, a particularly uniform damping can take place by means of a correspondingly large surface, which leads to a robust decoupling of the drive unit and the mounting.

In some embodiments, the decoupling arrangement comprises at least one O-ring as oscillation decoupling damping element. In this way a particularly economical and effective decoupling of the drive unit from the mounting can be achieved. For position securing in the axial direction relative to the longitudinal axis of the drive unit, the O-ring can be retained in a groove in the mounting or a groove in the drive unit, for example in a housing of the drive unit. Moreover, if a groove is provided in the mounting and a groove is provided in the drive unit, in which groove the at least one O-ring engages in the installed state, the decoupling produced in the radial and axial direction relative to the longitudinal axis of the drive unit by the at least one O-ring relative to the longitudinal axis of the drive unit can be used as position securing unit for the drive unit with respect to its position relative to the mounting. In this case the aforementioned advantages can be achieved in particular if the decoupling arrangement comprises at least two O-rings which are arranged axially offset with respect to the longitudinal axis of the drive unit.

A particularly effective decoupling or damping can be achieved if at least one oscillation damping element includes open-cell and/or closed-cell foam material.

According to some embodiments, if the mounting comprises a clamping device in which the drive unit is retained, wherein at least one clamping arm of the clamping device clamps around the drive unit from the exterior, the drive unit can be connected in a simple manner to the mounting. Furthermore, as a result even a correspondingly simple design of the decoupling arrangement can be achieved, so that overall a comparatively more cost-effective boat drive with a simple structure is achieved.

In order to ensure a particularly reliable retention of the drive unit and moreover a simple installation and disassembly, for example for maintenance purposes or transport purposes, in some embodiments the clamping device is configured as a sleeve, clamp, split shell or clip.

In some embodiments, the mounting comprises a flange for connection to a fastening region of the drive unit. In this case the flange, the fastening plate and the decoupling arrangement arranged between the flange and the fastening region are arranged in the interior of a housing of the drive unit. As a result, the connection between the mounting and the drive unit is, on the one hand, designed to be particularly stable reproducible, so that the drive unit can be retained very quietly in the water during operation and swerving movements or other deviating or compensating movements during operation which are caused by the propeller of the drive unit can be reduced or even completely prevented.

In some embodiments, the entire drive unit is encapsulated in a sleeve which is radially and axially decoupled relative to the mounting.

In some embodiments, the rotating parts of the drive unit, in particular a rotor of the electric motor, a bearing plate and/or a transmission, can be decoupled, for example, all together, from the mounting. In this case non-rotating parts such as the stator of the electric motor can be firmly connected to the mounting.

In some embodiments, for example, the supports such as for example the outer rings of the rolling bearings of the rotor of the electric motor in a gearless design, the so-called direct drive, can be mounted so as to be resiliently decoupled. This would be particularly simple and cost-effective.

The drive unit can comprise a seal between the mounting and/or an arm or shaft of the mounting, which seal seals off the interior of the housing relative to the surroundings. In this case the seal is more resilient, for example more soft elastic than the decoupling arrangement, so that no oscillations and vibrations are transmitted via the seal from the drive unit to the mounting and, on the other hand, a continuous sealing is guaranteed.

In order to prevent the drive unit in its connection relative to the mounting from being unintentionally changed in its position or even released, for example due to a degeneration or damage to parts of the decoupling device, in some embodiments a position securing unit for securing the position of the drive unit relative to mounting is provided, wherein the position securing unit is configured to counter rotation and/or displacement of the drive unit relative to the mounting.

Furthermore, by means of measurements it may be advantageous to determine the resonant frequency of the drive unit as well as the mounting, in particular the shaft thereof and/or the connection thereof to the boat, and to adapt at least one material of the decoupling device, for example a material of at least one oscillation decoupling damping element accordingly, so that the maximum damping occurs at the resonant frequency.

Alternatively, the at least one material of the decoupling device can be adapted in such a way that the oscillations generated by the drive unit in a specific driving operation, for example when cruising at, for example, 80% of the rated power of the electric drive, are damped in the drive unit particularly effectively. In other words, the damper hardness of the decoupling device is adapted to the respective range of use and also to the geometry of the boat drive and/or the geometry and the oscillation behavior of parts of the boat with the boat drive installed, in such a way that a particularly substantial decoupling is achieved in a specific operating range, and thus disruptive vibrations on the boat as well as noise emissions in this operating range can be particularly effectively reduced or even completely prevented.

This is advantageous in particular if at least some parts of the boat drive have a modular construction. Thus, for example, in order to be able to attach the boat drive to boats of different size and/or dimensions and to operate it, if a shaft of the mounting is replaced by a shaft of a different length an adaptation of the damping behavior of the decoupling device to the new shaft and the resulting changed oscillation behavior can be carried out.

The more resilient and soft elastic, respectively, the materials or the structure of the decoupling device are chosen to be, the more intensive the oscillations between the drive unit and the mounting can be damped and/or the natural frequency of the boat drive can be reduced. However, when setting or adjusting the damper hardness care should be taken to ensure that the necessary support function of the mounting for connection of the drive unit is maintained, and thus the connection between the mounting and the drive unit remains stable enough. Consequently, when setting or adjusting the damper hardness the damping function and the support function should be taken into consideration.

In some embodiments, a damping adjustment device for adjusting a damper hardness of the decoupling device is provided. As a result, it is possible to adapt the damper hardness of the decoupling device to respective operating and usage conditions which usually change during operation of the boat drive and so, over substantially the entire operating range of the boat drive, to achieve substantial decoupling of the drive unit from the mounting, and thus substantial damping of the oscillations and vibrations, respectively, transmitted by the drive unit to the mounting.

Adaptable damping adjustment devices, in which a setting or change of the damper hardness of at least one damping element takes for example by means of a change to an electrical voltage or a fluid pressure takes place, are known in principle and are not explained further here.

In this case, the change or adaptation of the damper hardness can take place manually or by means of a controller which controls the damper hardness as a function of an input value, for example an actual load of the electric motor of the drive unit or the speed. Alternatively, a regulation of the damper hardness can take place by means of a control loop of the damping adjustment device.

In some embodiments, at least one oscillation sensor senses an oscillation of the drive unit and/or the mounting, wherein the damping adjustment device adjusts the damper hardness on the basis of the values obtained by the at least one oscillation sensor. In this way the damper hardness for the actual operational state of the boat drive can always be adapted in such a way that the decoupling is particularly substantial at any time, and consequently the transmission of the oscillations from the drive unit to the mounting is always minimized.

BRIEF DESCRIPTION OF THE FIGURES

Specific non-limiting embodiments of the present disclosure are explained in more detail with reference to the description of the following Figures. These show schematically.

While the above-identified drawings set forth presently disclosed embodiments, other embodiments are also contemplated, as noted in the discussion. This disclosure presents illustrative embodiments by way of representation and not limitation. Numerous other modifications and embodiments can be devised by those skilled in the art which fall within the scope and spirit of the principles of the presently disclosed embodiments.

DETAILED DESCRIPTION

Exemplary embodiments are described below with reference to the figures. In this case elements which are similar or equivalent are provided with identical reference signs in the different figures, and in some instances a repeated description of these elements is dispensed with in order to avoid redundancy.

Figure 1:
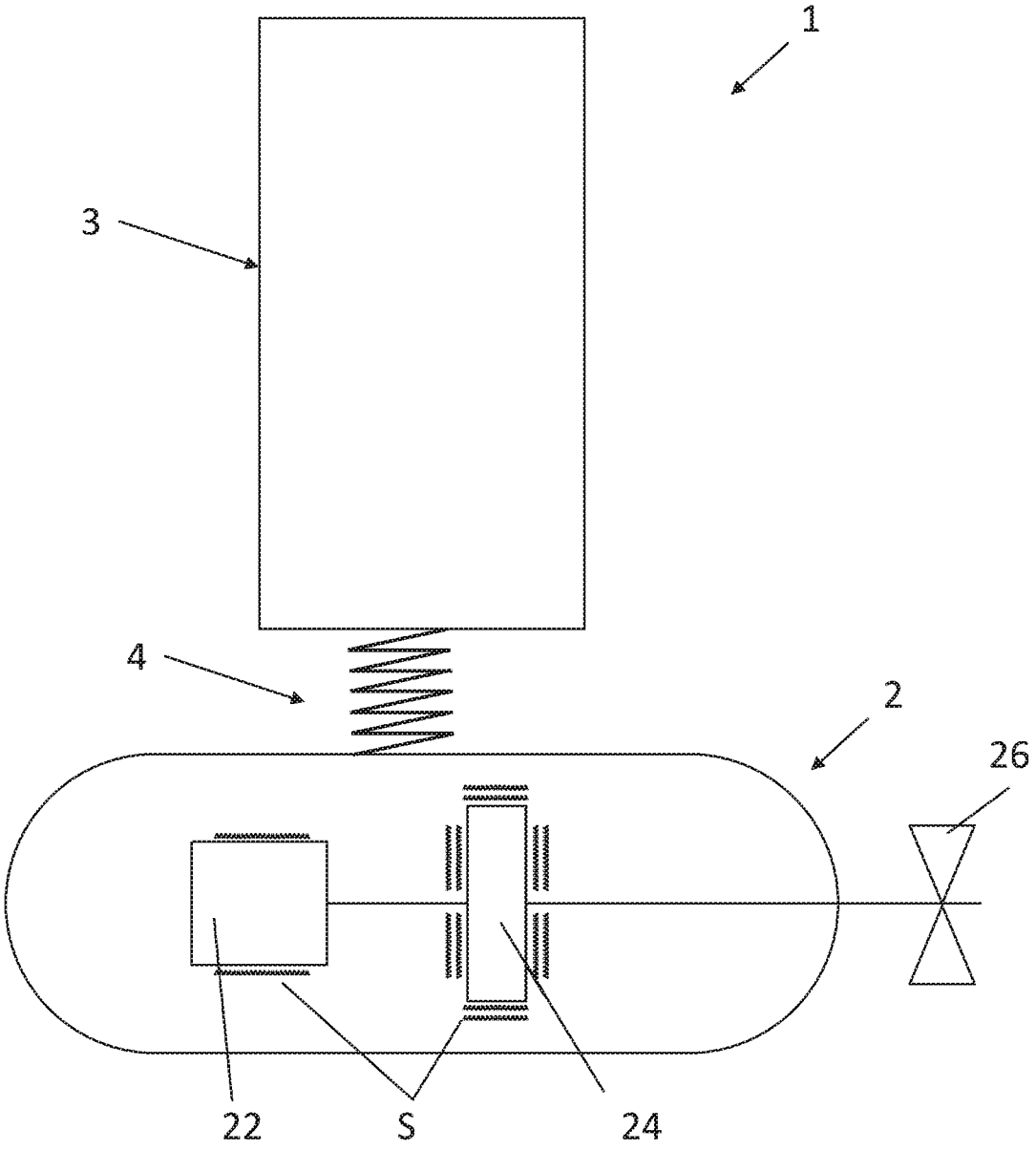
FIG. 1 shows schematically an operational principle of a boat drive according to the present disclosure.

FIG. 1 shows schematically an operational principle of a boat drive 1 according to the present disclosure. This boat drive comprises a drive unit 2, in the interior of which is arranged an electric motor 22 which in this embodiment is connected by means of a transmission 24 to a propeller 26 for generating propulsion. In alternative embodiments the transmission can also be dispensed with and the propeller 26 is connected directly to the electric motor 22.

The boat drive 1 further comprises a mounting 3, by means of which the drive unit 2 can be attached to a boat having the boat drive 1. As a rule, the boat drive 1 is attached to a boat in such a way that the axis of the propeller 26 is arranged substantially horizontally. Furthermore, the drive unit 2 is generally rotatable or pivotable about at least one axis.

A decoupling device 4, by means of which the drive unit 2 is decoupled from the mounting 3, is provided between the drive unit 2 and the mounting 3. In this way it is possible for oscillations, which are indicated here by the reference sign S, and vibrations, respectively, which are generated during operation of the boat drive 1 in the electric motor 22 and in particular are generated in the transmission 24, to be damped in the fastening region of the mounting 3 and the drive unit 2. Consequently, the oscillations S are either transmitted with (greatly) reduced amplitude to the mounting 3 or are even completely prevented from transferring to the mounting 3. Due to damping of the oscillations the mounting 3 produces less noise, depending on the degree of damping, so that a quiet and low-vibration ride is possible with a boat having the boat drive 1.

Figure 2:
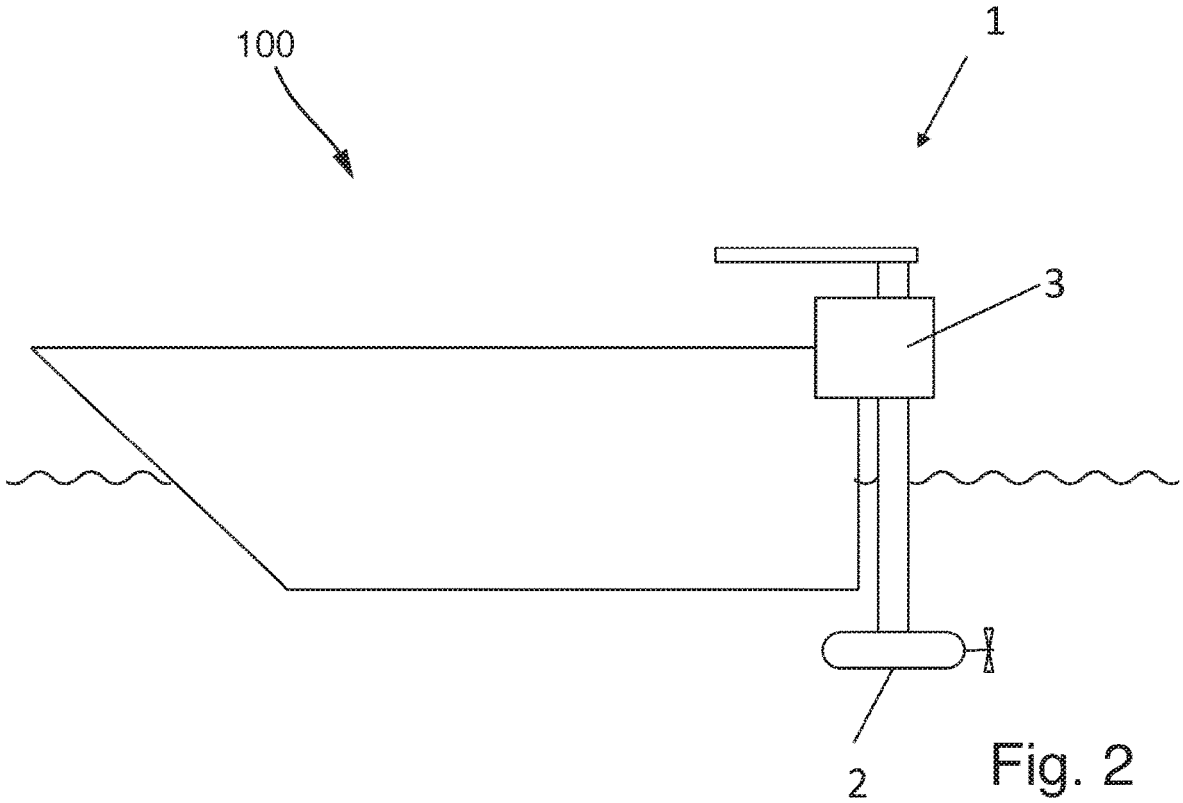
FIG. 2 shows schematically a boat on which a boat drive according to the present disclosure is arranged.

FIG. 2 shows schematically a boat 100 on which a boat drive 1 according to the present disclosure is arranged. In this case the boat drive 1 is designed as an outboard drive and is fastened by means of the mounting 3 on the transom (not shown) of the boat 1. The mounting serves for pivotable connection of the drive unit 2 to the boat 100, wherein the mounting 3 extends partially below the surface of the water, so that the drive unit 2 is located underwater.

Figure 3:
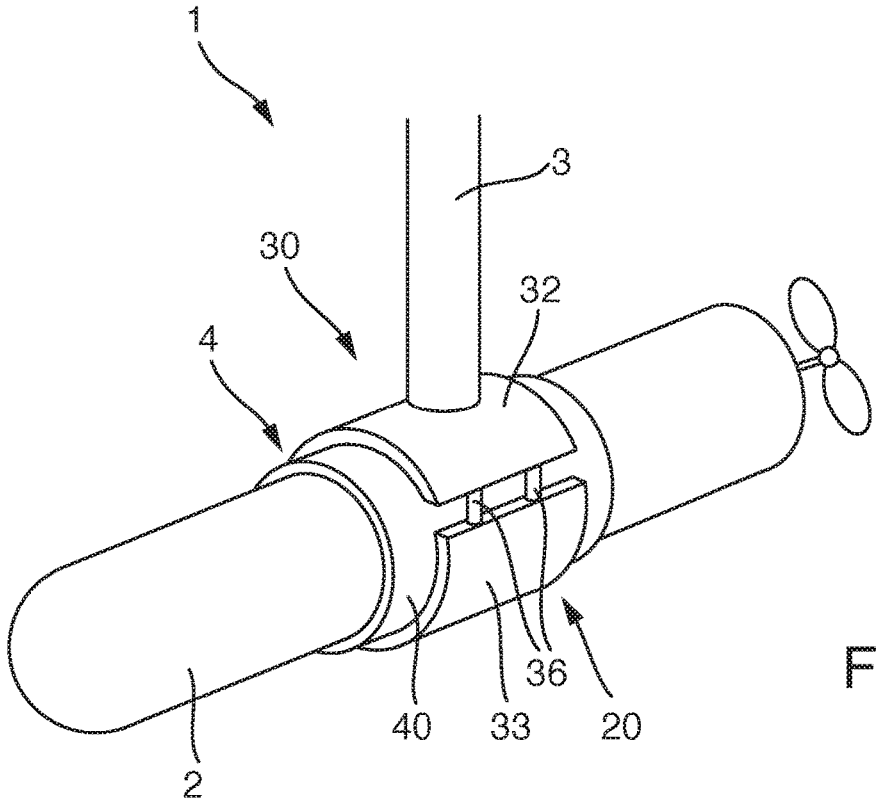
FIG. 3 shows a schematic perspective side view of a part-region of the boat drive according to FIG. 2.

FIG. 3 shows a schematic perspective side view of a part-region of the boat drive 1 according to FIG. 2. This shows clearly that the mounting 3 comprises a clamping device 30 in which the drive unit 2 is retained. For this purpose, the clamping device 30 comprises a first clamping arm 32 on the side of the mounting 3 and an opposing second clamping arm 33. The drive unit 2 designed in the form of a pylon is arranged between the two clamping arms.

Furthermore, the clamping device 30 comprises fastening elements 36, in the present case configured as screws, by which the spacing between the first and second clamping arms 32, 33 can be varied and thus a clamping force can be exerted on the drive unit 2 located in the clamping device 30. For this purpose, the drive unit 2 comprises, in the region of the clamping device 30, a rigid fastening region 20, so that a sufficiently high clamping force action can be generated and thus the drive unit 2 can be securely retained by the mounting 3.

Alternatively, other types of fasteners can be used individually or in combination, for example rivets, clasps, pin connections and/or locking bolts, and also cohesive bonding such as gluing, soldering or welding.

In some alternative embodiments, the clamping device 30 can be configured in the form of a sleeve, clamp or clip.

A decoupling arrangement 4, which decouples the mounting 3 from the drive unit 2 with respect to oscillations, is provided between the mounting 3 and the drive unit 2. Therefore, oscillations and vibrations, respectively, generated by the drive unit 2 are damped by the decoupling arrangement 4, so that they are transmitted, greatly reduced, to the mounting 3. In this case the damping effect of the decoupling device 4 is chosen so that when the boat drive is in cruising mode, in which the electric motor of the drive unit 2 is operated for example at approximately 80% of its rated power, the oscillations are greatly reduced in such a way that, in terms of their frequency, the noise emissions generated by the mounting oscillating with the damped oscillation amplitude lie substantially below a sound pressure level which is still perceptible to the human ear.

Figure 4:
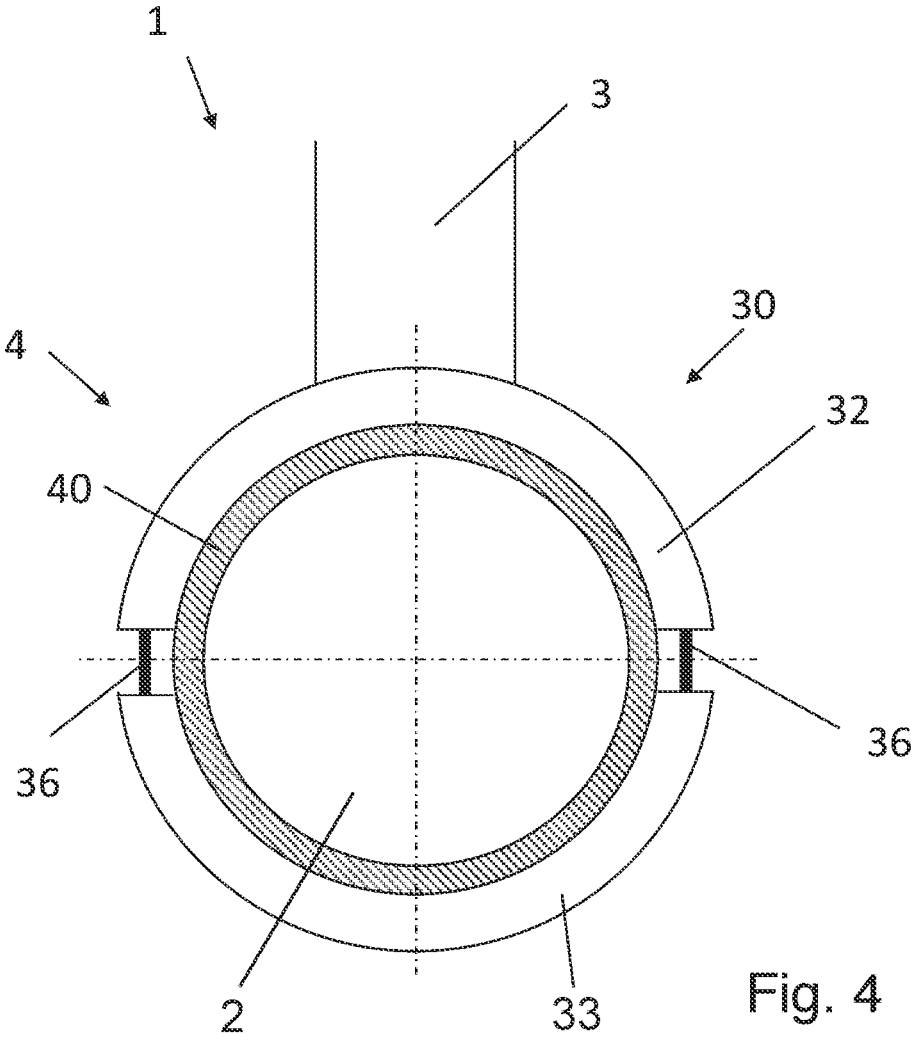
FIG. 4 shows a schematic sectional view of the boat drive according to FIG. 3.

As can be seen in particular in FIG. 4, which shows a schematic sectional view of the boat drive according to FIG. 3, the decoupling arrangement 4 in the embodiment illustrated in FIG. 3 comprises an oscillation decoupling damping element in the form of a continuous intermediate layer 40 of a salt water resistant, resilient polyurethane compound. Alternatively, the intermediate layer 40 can also be produced from another resilient material, such as an elastomer, particularly rubber, for example natural rubber. The intermediate layer 40 comprises substantially the shape of a tube section or hose section, which is adapted to the external contour of the drive unit 2 and is slipped onto this drive unit.

Figure 5:
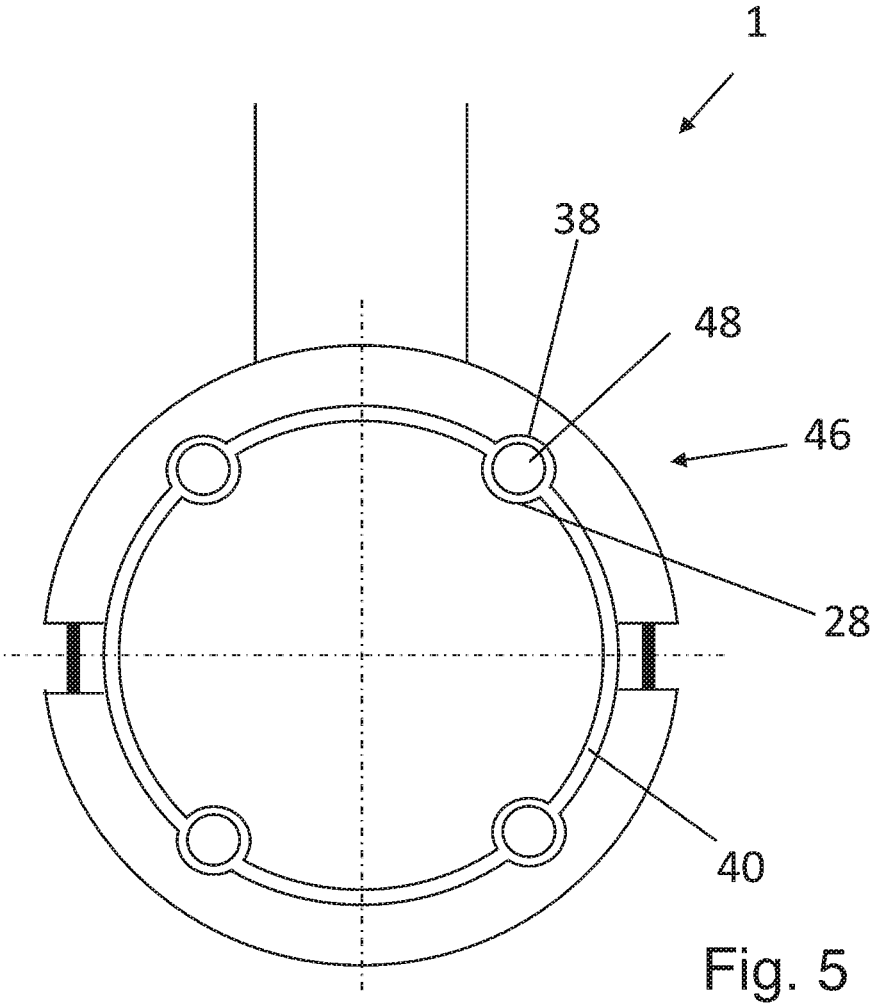
FIG. 5 shows a schematic sectional view of a boat drive in a further embodiment.

FIG. 5 shows a schematic sectional view of a boat drive 1 in a further embodiment. The boat drive 1 illustrated there corresponds substantially to the drive according to FIG. 3, wherein in the boat drive 1 illustrated in FIG. 5 a position securing unit 46 is provided for securing the position of the drive unit 2 relative to the mounting 3. In this case, viewed in the circumferential direction of the intermediate layer 40, rod segments 48 are arranged regularly spaced apart in the intermediate layer 40 and extend in parallel with the longitudinal axis of the drive unit 2. In the present case the rod segments 48 are received in the intermediate layer 40 and are radially completely surrounded thereby. In order to receive the rod segments 48, corresponding grooves 28, 38 are provided in the mounting 3 and also in the drive unit 2.

The rod segments 48 can be made of a stable material, for example a plastic with increased strength by comparison with the material of the intermediate layer 40, or of metal. In a further development the rod segments likewise have a resilient material different from the resilient material of the intermediate layer 40.

Since the rod segments 48 are completely surrounded by the material of the intermediate layer 40, oscillation damping also occurs in the region of the rod segments 48.

In this case the position securing unit 46 is designed to prevent a rotation of the drive unit 2 about the longitudinal axis thereof relative to the mounting 3. Securing against displacement of the drive unit 2 along its longitudinal axis can also be achieved by the provision of a further position securing element (not shown) extending in the circumferential direction of the intermediate layer 40.

Alternatively, securing of the position can also be provided by at least one formation in the mounting 3 and/or the drive unit 2 which engages in at least one correspondingly complementary recess or depression on the drive unit 2 or mounting 3. In this case at least one oscillation decoupling damping element is arranged between the at least one formation and the at least one depression, in order to provide damping also in this region.

If in the assembled state of the boat drive 1, the formation and the depression are spaced apart from one another, it is also possible to dispense with an intermediate layer there. The position securing unit then acts only in the event of a change of the drive unit 2 relative to the mounting 3. Thus the at least one formation only comes into contact with the at least one depression in the event of a change of position, so that generated in the drive unit 2 are transmitted unhindered to the mounting 3. The oscillations then transmitted in turn generate noise emissions which signal to a person operating the boat drive 1 that the drive unit 2 has experienced a change of position.

Furthermore, a position sensor can be provided which senses the position of the drive unit 2 relative to the mounting 3 and, if the position of the drive unit 2 changes by a predetermined threshold value, a signal unit can be provided which then signals the change of position of the drive unit 2 relative to the mounting 3 or signals that the threshold value has been exceeded.

Figure 6:
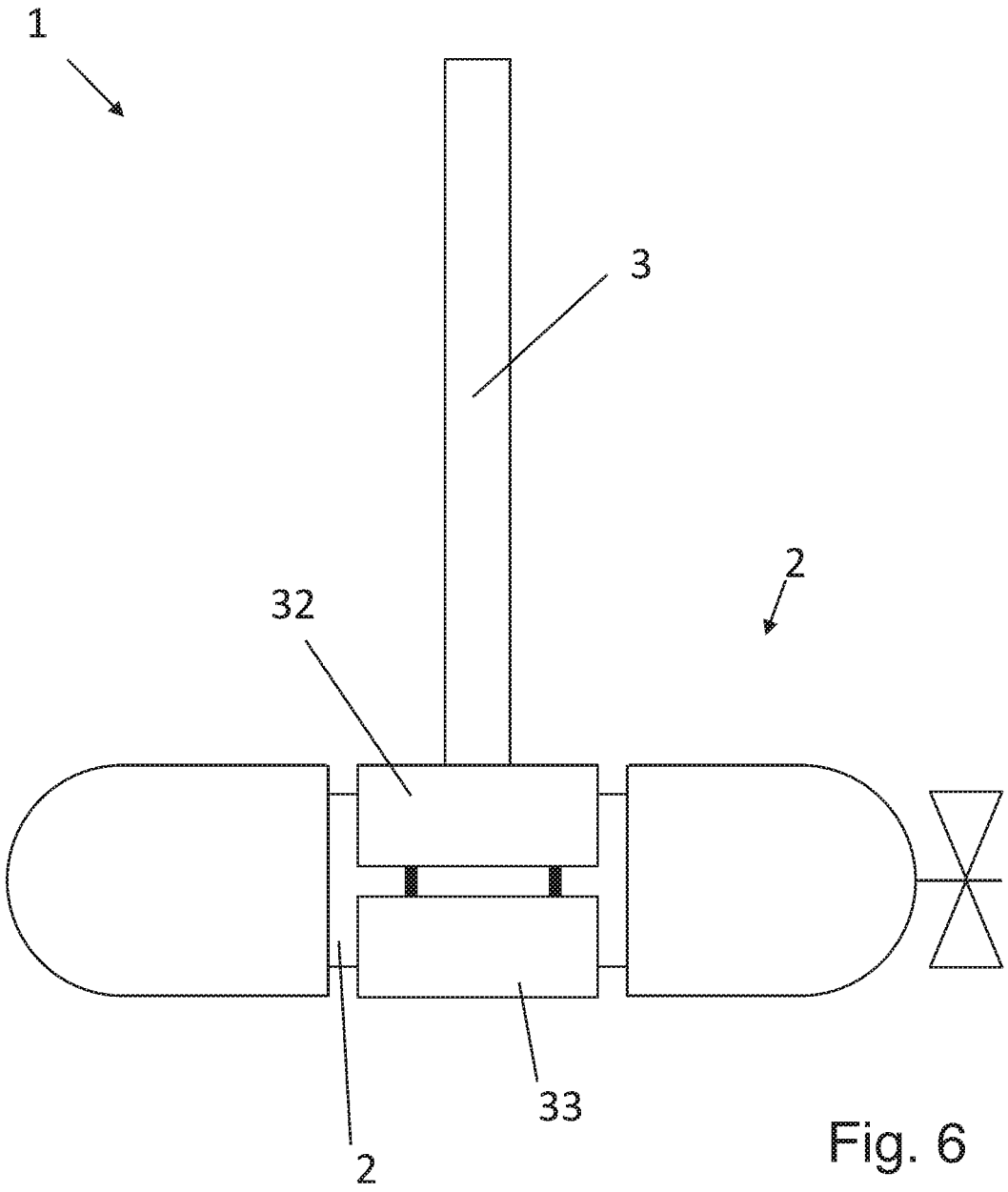
FIG. 6 shows a schematic side view of a boat drive in a further embodiment.

FIG. 6 shows a schematic side view of a boat drive 1 in a further embodiment. In contrast to the boat drive 1 according to FIG. 3, the drive unit 2 here comprises an offset fastening region 20. As a result, the external contour of the clamping arms 32, 33 of the clamping device 30 substantially corresponds here to that of the drive unit 2. Thus, the external diameter of the drive unit 2 and that of the clamping device 30 are approximately the same, so that a substantially streamlined configuration of the drive unit 2 is also provided in the fastening region 20. Consequently, the flow resistance of the boat drive 1 according to FIG. 6 is lower relative to the boat drive 1 shown in FIG. 3.

Figure 7:
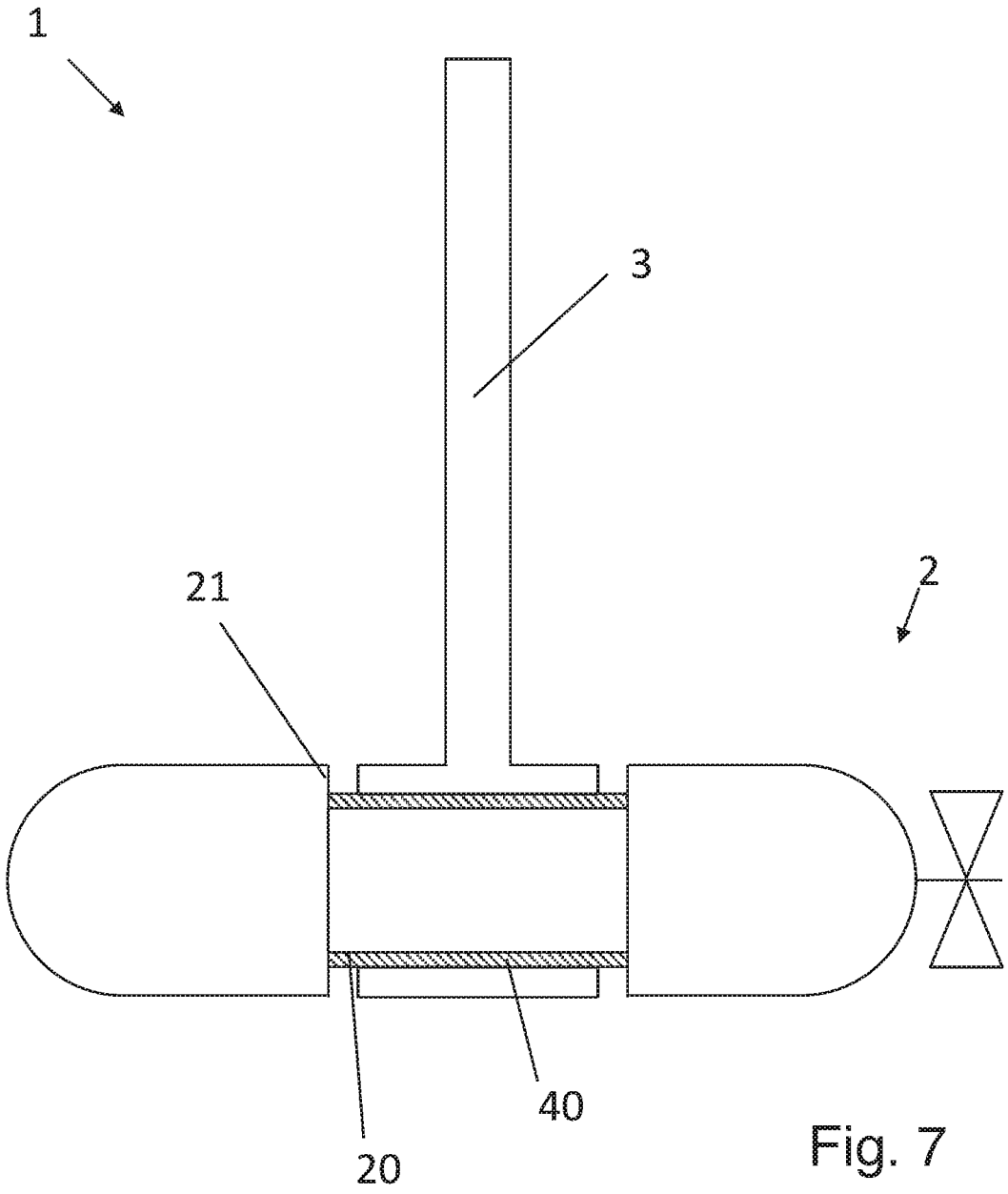
FIG. 7 shows a schematic sectional view of the boat drive according to FIG. 6.

A schematic sectional view of the boat drive according to FIG. 6 can be seen from FIG. 7. Between the mounting 3 and the drive unit 2, a decoupling device 4 in the form of an annular or hollow cylindrical or tubular segment shaped intermediate layer 40 made of a rubber is vulcanized onto the fastening region 20.

Furthermore, a position securing unit 46 against a displacement of the drive unit 2 along its longitudinal axis in relation to the mounting 3 is provided by the offset fastening region 20. The clamping device 30 engages positively in the fastening region 20. In the event of a movement of the drive unit 2 along its longitudinal axis out of the position shown in FIG. 7 there would be a contact between the clamping arms 32, 33 and a side wall 21 of the fastening region 20. Due to this positive engagement a further movement of the drive unit 2 is prevented. As a result, the drive unit 2 can be prevented from slipping out of the clamping device 30 in the event of a damaged intermediate layer 40. Alternatively, the region between the clamping device 30 and the side walls 21 can also be filled with a resilient material.

Figure 8:
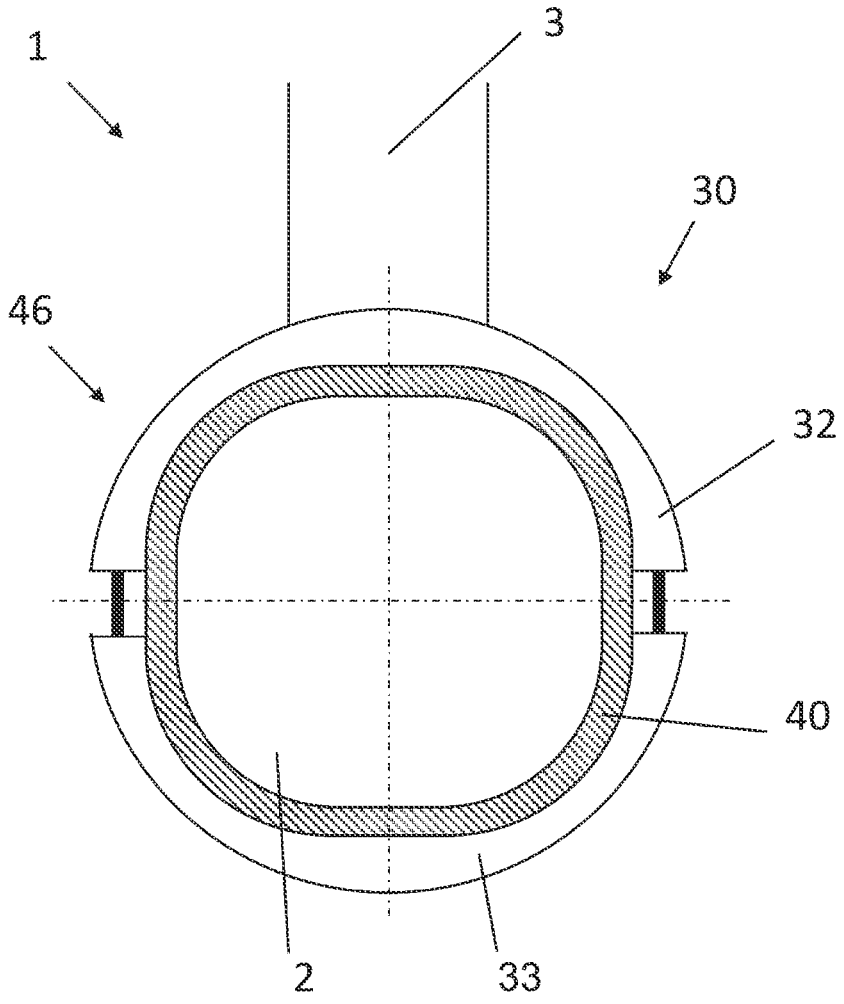
FIG. 8 shows a further schematic sectional view of the boat drive according to FIG. 6.

As can be clearly seen from FIG. 8, which shows a schematic sectional view of the boat drive 1 according to FIG. 6 perpendicularly to the longitudinal axis of the drive unit 2, the fastening region 20 comprises a non-round contour externally and correspondingly the intermediate layer 40 as well as inner sides of the clamping arms 32, 33 have a non-round contour. The non-round shape ensures a position securing unit against a rotation of the drive unit 2 about its longitudinal axis. Furthermore, in this way the torques from the drive unit 2 can be transmitted particularly uniformly to the mounting 3.

Figure 9:
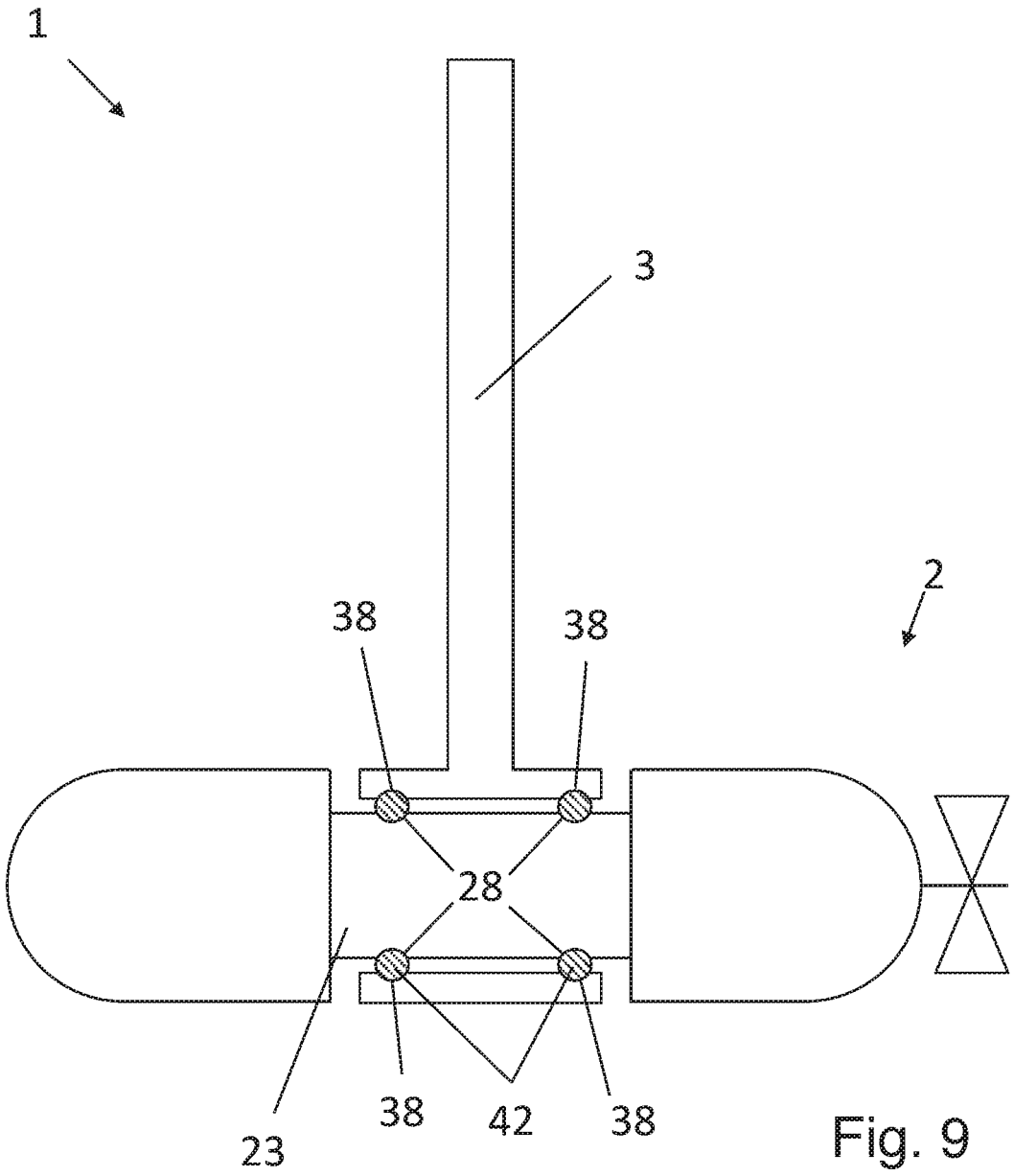
FIG. 9 shows schematically a boat drive in a further embodiment.

FIG. 9 shows schematically a boat drive 1 in a further embodiment. The structure of the boat drive 1 corresponds substantially to that according to FIG. 7. Instead of the continuous hollow cylindrical intermediate layer as decoupling arrangement 4, two O-rings 42 are provided which engage in corresponding grooves 28, 38 in the housing 23 of the drive unit 2 and in the mounting 3. The O-rings 42 decouple the drive unit 2 in this case both in the radial and also the axial direction in relation to the longitudinal axis of the drive unit 2.

Figure 10:
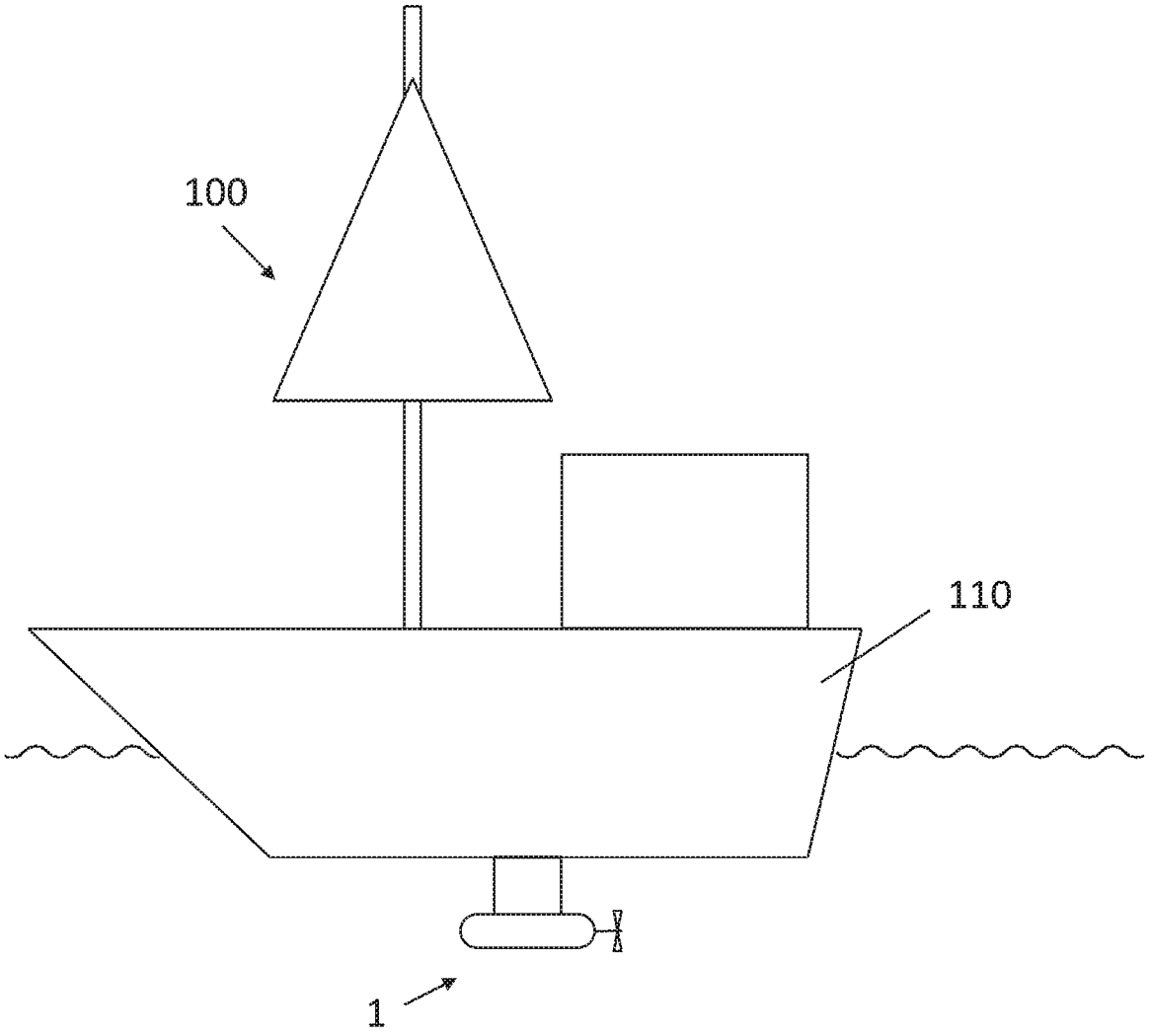
FIG. 10 shows schematically a further boat with a boat drive in a further embodiment.

FIG. 10 shows schematically a further boat 100 with a boat drive 1 in the form of a pod drive. The boat in FIG. 10 is a sailing yacht, wherein the pod drive is arranged in the lower region of the hull 110 of the yacht.

Figure 11:
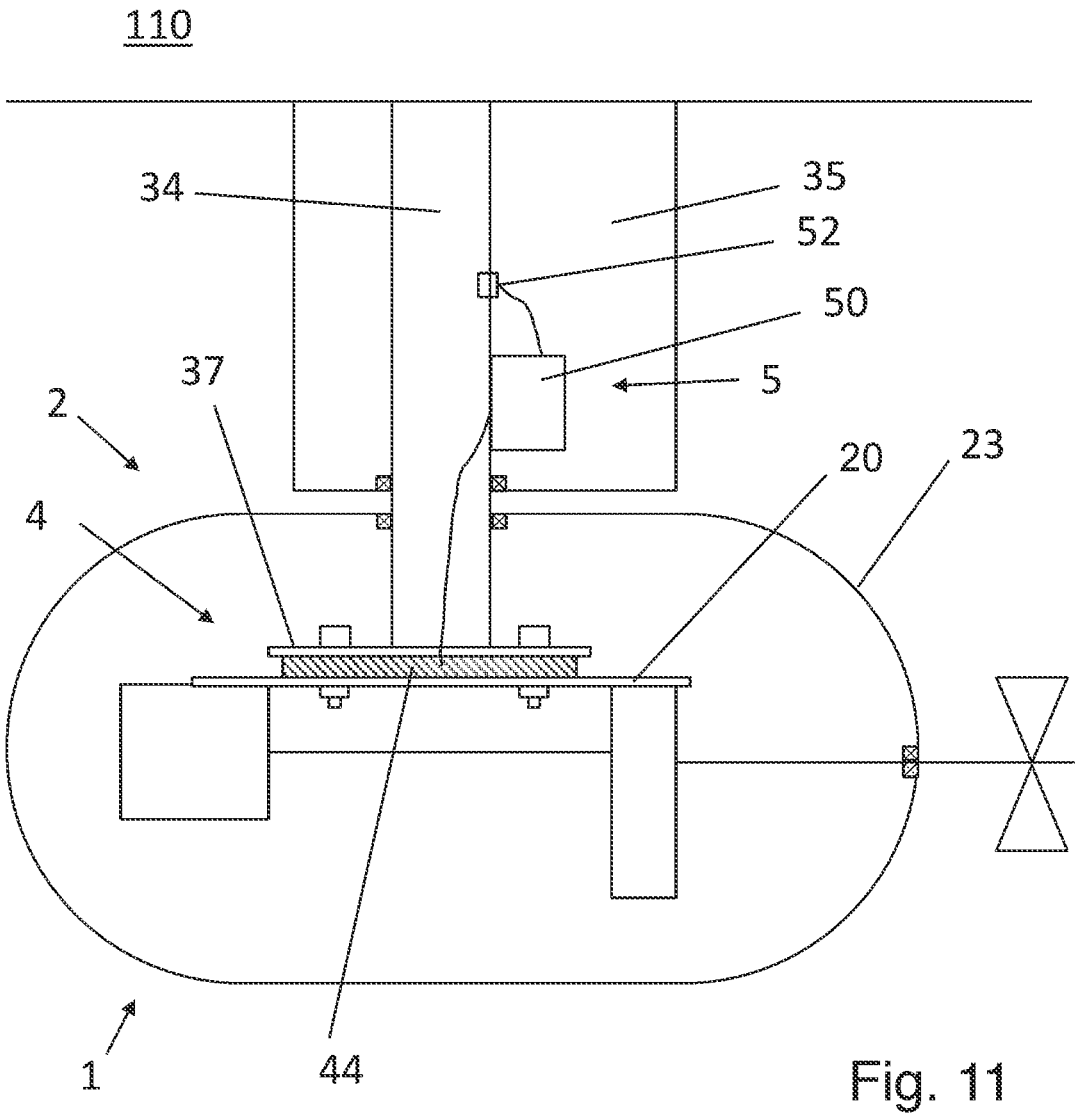
FIG. 11 shows a schematic sectional view of the boat drive according to FIG. 10.

FIG. 11 shows a schematic sectional view of the boat drive 1 according to FIG. 10. The mounting 3 of the boat drive comprises a shaft 34 which is fastened rotatably to the hull and is surrounded by a streamlined profiled cover 35 rigidly connected to the hull 110. The shaft 34 extends into the interior of a streamlined housing 23 of the drive unit 2.

At the lower end of the shaft 34 this shaft comprises a flange 37 by means of which the drive unit 2 is connected to the mounting 3 at a fastening region 20. For decoupling of the mounting 3 and the drive unit 2, an oscillation decoupling damping element 44, the damper hardness of which can be set, is arranged between the flange 37 and the fastening region 20.

In addition to the intermediate layer 40, at least one spring element (not shown) can be provided in order to facilitate an improved shock-absorbing action of the decoupling arrangement 4.

Alternatively, the decoupling device 4 can also be configured in the form of a rag joint.

The boat drive 1 according to FIG. 11 also comprises a damping adjustment device 5. For this purpose, an oscillation sensor 52, which transmits signals to a damper hardness adjustment unit 50, is arranged on the mounting 3. The oscillation sensor 52 senses the oscillations on the shaft 34. By this means the damper hardness adjustment unit 50 determines an optimal damper hardness and adjusts the current damper hardness of the oscillation decoupling damping element 44 to the determined optimal value. In this way it is ensured that the damping of the oscillations by the decoupling arrangement 4 always takes place in the best possible manner and is adapted to changing operating conditions of the boat drive 1 during operation thereof.

If applicable, all individual features which are set out in the exemplary embodiments can be combined with and/or exchanged for one another without departing from the scope of the present disclosure.

The invention claimed is:

1. A boat drive for driving a boat, comprising:

a drive unit comprising an electric motor;

a mounting connected to the drive unit for connecting the drive unit to the boat, wherein the mounting is provided for distancing the drive unit from a hull of the boat;

a clamping device on an end of the mounting having at least one clamping arm that is configured to clamp around an exterior of the drive unit to connect the drive unit to the mounting; and a decoupling arrangement positioned between the drive unit and the clamping arm of the mounting such that the decoupling arrangement is configured to decouple oscillations generated in the drive unit from the mounting.

2. The boat drive according to claim 1, wherein the decoupling arrangement comprises at least one oscillation decoupling damping element which is arranged between the drive unit and the mounting.

3. The boat drive according to claim 2, wherein the at least one oscillation decoupling damping element comprises a resilient material.

4. The boat drive according to claim 3, wherein the resilient material is an elastomeric material.

5. The boat drive according to claim 3, wherein the resilient material is rubber.

6. The boat drive according to claim 2, wherein the at least one oscillation decoupling damping element comprises at least two materials with differing resilience.

7. The boat drive according to claim 6, wherein the at least two materials are at least two resilient materials.

8. The boat drive according to claim 2, wherein the at least one oscillation decoupling damping element is configured as a substantially continuous intermediate layer.

9. The boat drive according to claim 1, wherein the clamping device is configured as a sleeve, clamp or clip.

10. The boat drive according to claim 1, wherein the mounting comprises a flange for connection to a fastening region of the drive unit, wherein the flange, the fastening region and the decoupling arrangement are arranged between the flange and the fastening region.

11. The boat drive according to claim 1, further comprising a position securing unit for securing the position of the drive unit relative to the mounting.

12. The boat drive according to claim 11, wherein the position securing unit is designed to counter at least one of rotation or displacement of the drive unit relative to the mounting.

13. The boat drive according to claim 1, further comprising a damping adjustment device for adjusting a damper hardness of the decoupling arrangement.

14. The boat drive according to claim 13, wherein at least one oscillation sensor senses at least one of an oscillation of the drive unit or the mounting.

15. The boat drive according to claim 14, wherein the damping adjustment device adjusts the damper hardness on a basis of values obtained by the at least one oscillation sensor.

16. The boat drive according to claim 1, further comprising one or more rod segments positioned in the decoupling arrangement, the one or more rod segments being configured to extend parallel to a longitudinal axis of the drive unit to secure the drive unit relative to the mounting to counter rotation of the drive unit relative to the mounting.

17. The boat drive according to claim 1, wherein an internal surface of the clamping arm and an outer surface of the drive unit have a non-round cross-sectional contour to secure the drive unit relative to the mounting to counter rotation of the drive unit relative to the mounting.

18. A boat drive comprising:

a drive unit comprising an electric motor;

a mounting engaging the drive unit for engaging the drive unit to a boat, wherein the mounting distances the drive unit from a hull of the boat, a clamping device on an end of the mounting having at least one clamping arm that is configured to clamp around an exterior of the drive unit to connect the drive unit to the mounting; and a decoupling arrangement arranged between the drive unit and the clamping arm of the mounting, the decoupling arrangement having at least one oscillation decoupling damping element comprising a resilient material;

wherein the decoupling arrangement decouples oscillations generated in the drive unit.

19. The boat drive according to claim 18, wherein the at least one oscillation decoupling damping element comprises at least two materials with different resiliencies.

* * * * *